US009982882B2

(12) United States Patent
Welters

(10) Patent No.: US 9,982,882 B2
(45) Date of Patent: May 29, 2018

(54) BOILER WALL PROTECTION BLOCK, BOILER WALL PROTECTION ELEMENT, ASSEMBLY OF SUCH ELEMENT AND A FERRULE, A BOILER WALL PROVIDED WITH SUCH ASSEMBLY, METHOD FOR FURNISHING A BOILER INNER WALL AND A BOILER WALL PROTECTION SUB-BLOCK

(71) Applicant: Innalox B.V., Tegelen (NL)

(72) Inventor: Mark Peter Maria Welters, Venlo (NL)

(73) Assignee: Innalox B.V., Tegelen (NL)

( * ) Notice: Subject to any disclaimer, the term of this patent is extended or adjusted under 35 U.S.C. 154(b) by 0 days. days.

(21) Appl. No.: 14/427,152

(22) PCT Filed: Sep. 12, 2013

(86) PCT No.: PCT/NL2013/050656
§ 371 (c)(1),
(2) Date: Mar. 10, 2015

(87) PCT Pub. No.: WO2014/042527
PCT Pub. Date: Mar. 20, 2014

(65) Prior Publication Data

US 2015/0233574 A1 Aug. 20, 2015

(30) Foreign Application Priority Data

Sep. 12, 2012 (NL) ..... 2009451

(51) Int. Cl.
*F22B 37/08* (2006.01)

(52) U.S. Cl.
CPC ..... *F22B 37/08* (2013.01); *Y10T 29/49387* (2015.01)

(58) Field of Classification Search
CPC ..... F22B 37/08
See application file for complete search history.

(56) References Cited

U.S. PATENT DOCUMENTS 1,046,132 A * 12/1912 Winslow ..... F22B 9/04 122/114
3,628,572 A * 12/1971 Shannon ..... F16L 59/024 138/149

(Continued)

FOREIGN PATENT DOCUMENTS

CA 2229626 C 12/1998
DE 1601947 A1 8/1970

(Continued)

OTHER PUBLICATIONS

Gasket—Jul. 27, 2012.*

*Primary Examiner* — Alissa Tompkins
*Assistant Examiner* — Nathaniel Herzfeld
(74) *Attorney, Agent, or Firm* — Wood Herron & Evans LLP

(57) ABSTRACT

A boiler tube protection block, comprising an essentially parallellogram shaped body (11), an annular cut-out at all four corners, with the cutting point of two adjacent sides as a center. An assembly of a boiler protection block and a ferrule (21) with a radius essentially corresponding to the central annular hole of the block. A boiler, and a method for furnishing a boiler inner wall, comprising applying protection blocks against the wall, and arranging ferrules through at least the annular cut-outs.

20 Claims, 11 Drawing Sheets

(56) References Cited

U.S. PATENT DOCUMENTS

| | | | | |
|---|---|---|---|---|
| 5,323,849 | A | 6/1994 | Korczynski, Jr. et al. | |
| 5,775,269 | A * | 7/1998 | Lawrence | F22B 37/08 122/511 |
| 6,173,682 | B1 | 1/2001 | Parnell et al. | |
| 7,240,723 | B2 * | 7/2007 | Wu | F28D 7/16 165/158 |
| 8,439,102 | B1 * | 5/2013 | Collins, III | F28F 19/002 122/512 |
| 2011/0024094 | A1 * | 2/2011 | Collins, III | F28F 19/002 165/134.1 |
| 2011/0290952 | A1 * | 12/2011 | Masters | F16L 3/223 248/68.1 |
| 2012/0325443 | A1 * | 12/2012 | Miyata | B21C 37/205 165/162 |

FOREIGN PATENT DOCUMENTS

| | | | |
|---|---|---|---|
| EP | 0277070 | A1 | 8/1988 |
| WO | 0070265 | A1 | 11/2000 |

* cited by examiner

BOILER WALL PROTECTION BLOCK, BOILER WALL PROTECTION ELEMENT, ASSEMBLY OF SUCH ELEMENT AND A FERRULE, A BOILER WALL PROVIDED WITH SUCH ASSEMBLY, METHOD FOR FURNISHING A BOILER INNER WALL AND A BOILER WALL PROTECTION SUB-BLOCK

CROSS-REFERENCE TO RELATED APPLICATIONS

This application is the United States national phase of International Application No. PCT/NL2013/050656 filed Sep. 12, 2013, and claims priority to The Netherlands Patent Application No. 2009451 filed Sep. 12, 2012, the disclosures of which are hereby incorporated in their entirety by reference.

BACKGROUND OF THE INVENTION

Field of the Invention

The present invention relates to a boiler wall protection block, an assembly of such block and a ferrule, and a boiler wall provided with such assembly.

Description of Related Art

Boilers are used in petrochemical applications, for instance in those for regaining sulphur from crude petroleum. Herein, gasses and fluids are burned to eliminate harmful substances, or to enable separation thereof. During this process, burning heat is regained by blowing the burning gasses through a boiler.

Since these gasses are usually corrosive and the temperatures are too high to submit the boiler walls thereto, and in particular the tube-panels covering those walls, a protection is required. For this purpose, multiple solutions are known in the art.

One solution is to apply a coating of downpoured or pulvered concrete against the tube panels, with through-holes for the tubes made by so-called ferrules.

Another solution is to apply ferrules with integrated blocks, that form part of a protection wall. The blocks may be designed in such way that they can be mounted in a wall-covering pattern. In the art, four and six-sided blocks are applied.

Yet another solution is to apply ferules provided with a flange at one outer edge, that cooperate with separate blocks, having a through hole in the middle, wherein the blocks may or may not be designed to cover an entire wall when applied in a pattern. This latter solution, with six-sided blocks, is for instance known from the U.S. Pat. No. 5,775,269 or the international patent application WO 2000/70265. The German patent publication DE 16 01 947 A1 describes a heat exchanger provided with features according to the prior art.

The existing solutions have certain disadvantages however. In particular, the blocks tend to get loose and as a result can cause the ferrule they surround to break, allowing hot corrosive gasses to attack the wall behind the adjacent blocks The purpose of the present invention is to take away the disadvantages of the prior art, or at least to provide a useful alternative.

SUMMARY OF THE INVENTION

The present invention thereto proposes a boiler wall protection block, comprising an essentially parallellogram shaped body with an annular cut-out at all four corners, with the cutting point of two adjacent sides as a centre.

The configuration according to the invention has multiple advantages. The lozenge shaped body allows the boiler wall protection block to cover walls with various surface forms, and thanks to its shape, it is held in place by more than one ferrule, which contributes to the overall robustness. In particular, the annular cut outs at the four corners enable one block to be held in place by multiple ferrules.

In an alternative embodiment, four of the above described blocks can be seen as one element, which means that the boiler tube protection block further comprises a central annular through hole for a ferrule and an annular cut-out at the middle of all four sides, with the centre coincident with the side; wherein the central annular through hole and the annular cut-outs at the middle of the four sides have the same radius as the annular cut-out at all four corners.

In a preferred embodiment, the boiler wall protection block comprises a first pair of adjacent flanges at an angle of 60 degrees, and a second pair of adjacent flanges at 120 degrees. This shape enables to cover a surface when laid in a pattern with identical blocks, without leaving intermediate holes or recesses.

In a further embodiment, the annular through hole and the annular cut outs have a rounded or tapered edge, for accepting a flange of a ferrule. The ferrule can thus be embedded in the block, which leads to a smoother and thus less fragile surface.

In yet a further embodiment, two adjacent sides have a protrusion, and the two other adjacent sides have a corresponding recess. When a boiler wall is furnished with blocks according to the present invention, adjacent blocks lock each other, more or less in a roofing-tile wise, while the assembly of blocks is kept in place by the ferrules, arranged in the annular holes of each separate blocks, and the annular holes formed by the annular cut outs of four adjacent blocks. Another advantage of this construction is that no direct radiation of heat can reach the boiler wall.

In a practical realisation, the protrusions and recesses may for instance extend over about half the thickness of the block. Such block can thus be imagined as a two-layer lozenge-shaped block, wherein the two layers are shifted over a distance in their length and width directions.

When arranging the boiler wall protection blocks according to the invention, a heat-resistant paper gasket may be applied between the ferrule and the annular through-hole, as well as between adjacent protection blocks, to assure a heat- and radiation tight connection. The ferrules to be used have a radius essentially corresponding to the central annular hole of the block, and for instance a six-sided or annular flange. This block may be manufactured from one or more compounds selected from the group consisting of $Al_2O_3$, $ZrO_2$, $SiO_2$, $TiO_2$, $Y_2O_3$, $Na_2O$, $Nb_2O_5$, $La_2O_3$, $Fe_2O_3$, CaO, SrO, $CeO_2$, MgO, $Cr_2O_3$, CuO, the mixed oxides thereof, SiC, TiC, $Si_3N_4$ and AlN.

In order to further prevent heat radiation to the boiler wall, a double layer of blocks may be applied, wherein blocks of the two layers are mutually rotated 120 degrees. In this case, rounded or tapered edges may only be considered necessary for the blocks that receive the flanges of the ferrules, which may form an inner layer. The outer layer, i.e. the layer between the inner layer and the boiler wall, may be manufactured without.

The blocks according to the invention may be massive or at least partially hollow, and cavities may be provided to be filled with concrete, for mounting the blocks to the boiler wall with pre-mounted anchors

BRIEF DESCRIPTION OF THE DRAWINGS

The invention will now be explained into more detail with reference to the following figures. Herein.

DETAILED DESCRIPTION OF THE INVENTION

Figure 1:
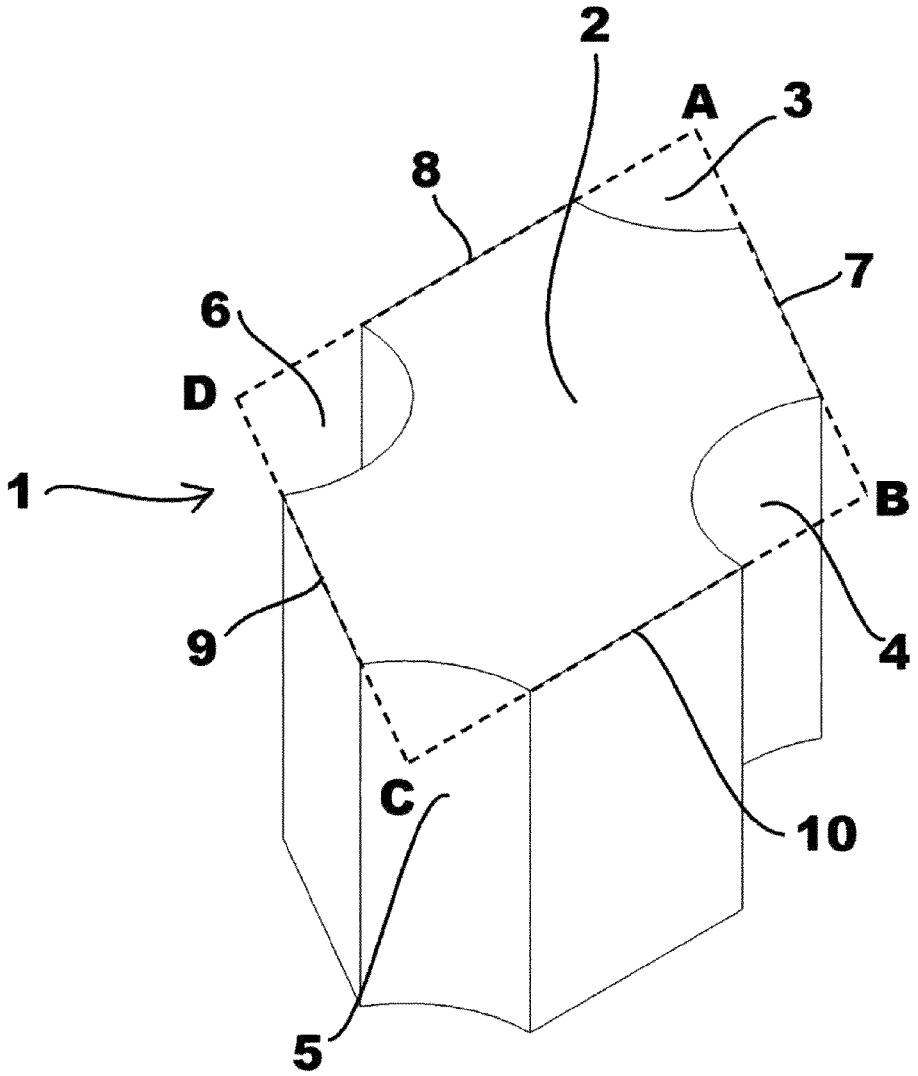
FIG. 1 shows a first embodiment of a block according to the invention.

FIG. 1 shows a first embodiment 1 of a block according to the invention. The block comprises an essentially lozenge shaped body 2, with an annular cut-out 3, 4, 5, 6 at all four corners, with the cutting point A, B, C, D of two adjacent sides 7, 8, 9, 10 as a centre.

Figure 2:
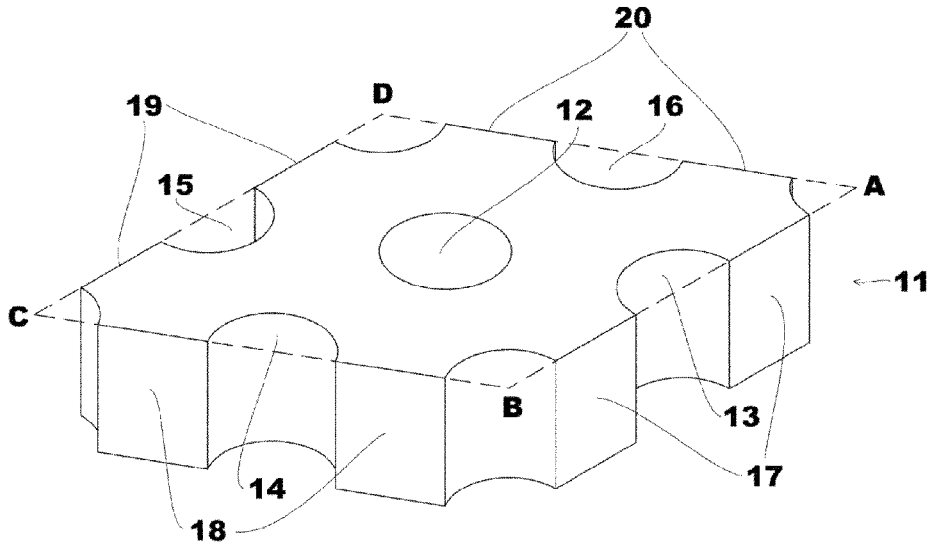
FIG. 2 shows a second embodiment of a block according to the invention.

FIG. 2 shows a second embodiment 11 of a block according to the invention, having a central annular through hole 12 for a ferrule, and annular cut-outs 13, 14, 15, 16 at the middle of all four sides, with the centre coincident with the side 17, 18, 19, 20.

Figure 3A:
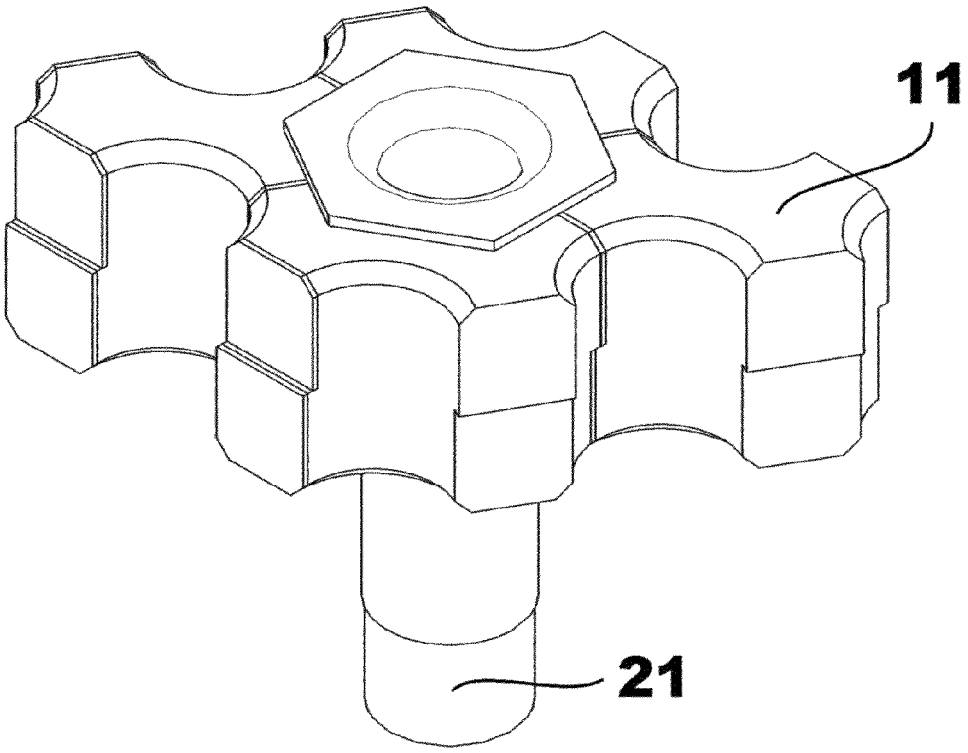
FIGS. 3*a, b* show a combination of a block according to the invention and a ferrule.
Figure 3B:
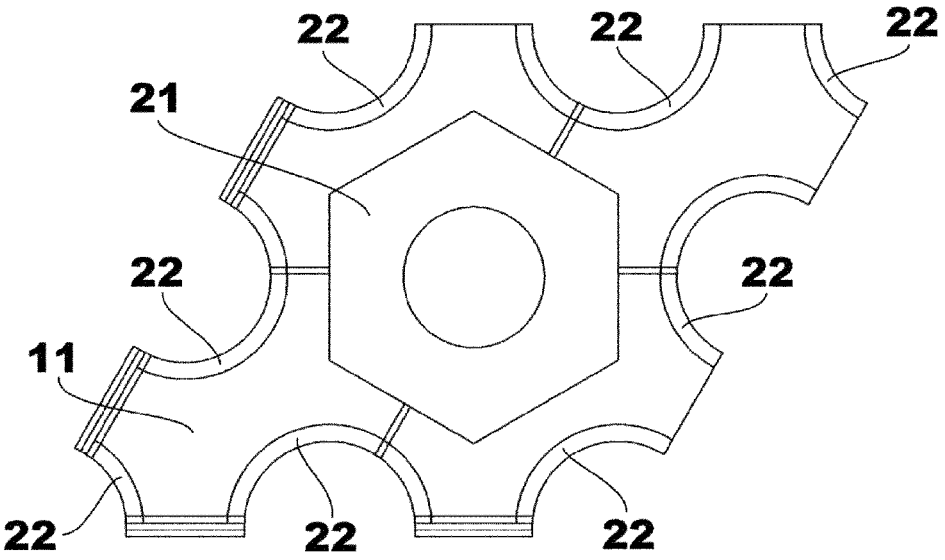

FIGS. 3*a* and *b* show different perspectives of a combination of a block 11 according to the invention and a ferrule 21. As can be seen in FIG. 3*b*, the annular holes and cut-outs are arranged such that adjacent six-sided flanges of ferrules fill the entire surface. The annular through hole and the annular cut outs have a rounded edges 22.

Figure 4A:
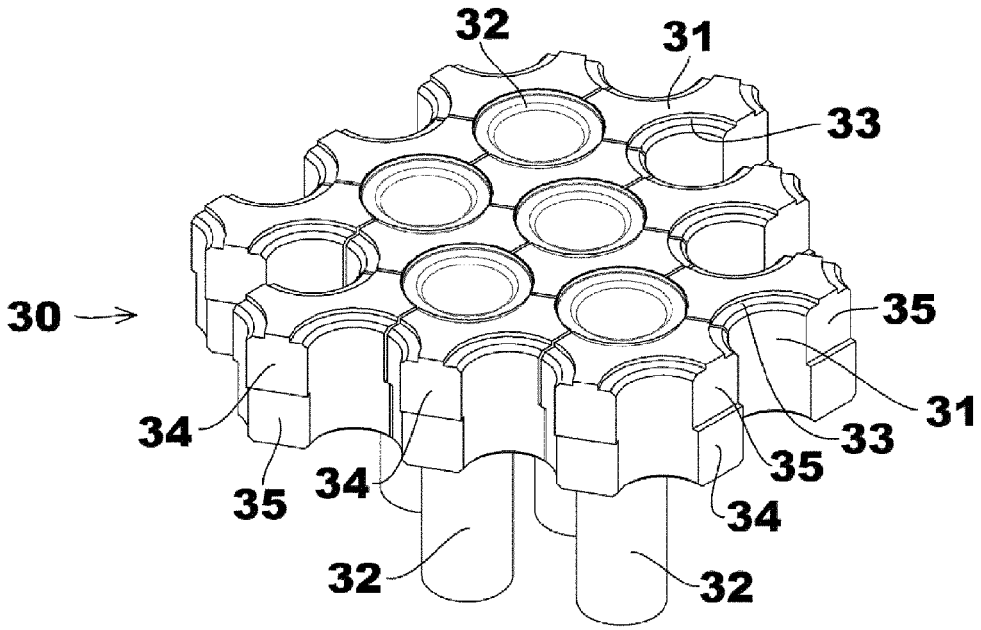
FIG. 4*a* shows a composition of multiple blocks and ferrules according to the invention.

FIG. 4*a* shows a composition 30 of multiple blocks 31 and ferrules 32 according to the invention. In this example, the ferrules 32 have annular flanges instead of the six-sided ones as shown in FIGS. 3*a*, 3*b*. The blocks 31 are provided with recesses 33 for receiving the annular flanges of the ferrules 31. Also visible in FIG. 4 is that two adjacent sides of the blocks 31 have a protrusion 34, and the two other adjacent sides have a corresponding recess 35. In the example given, the protrusions 34 and recesses 35 extend over about half the thickness of the block.

Figure 4B:
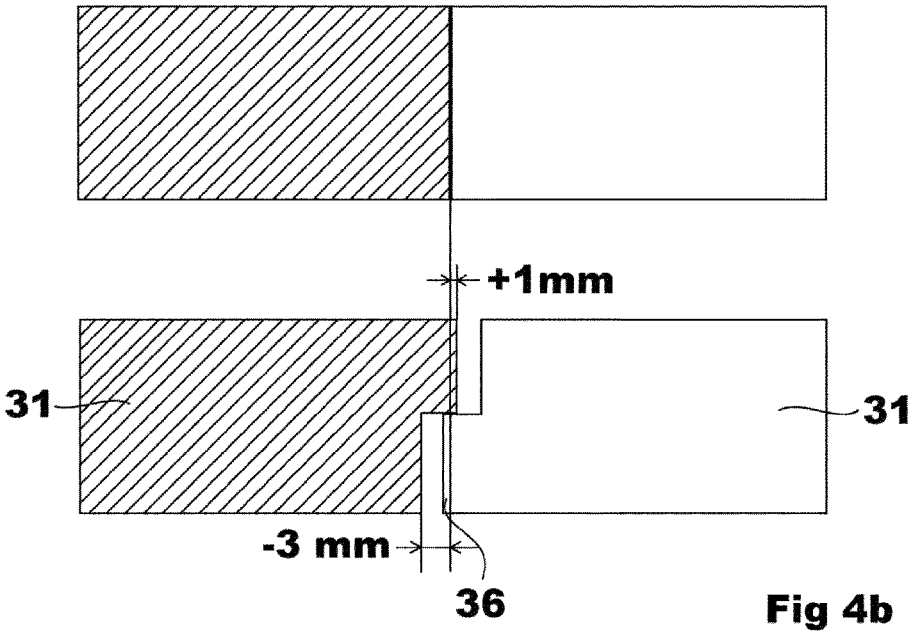
FIG. 4*b* shows the use of paper gaskets between blocks.

FIG. 4*b* shows the use of paper gaskets 36 between the blocks 31, for obtaining a gas-tight connection. The paper may for instance be 2 or 3 mm thick in an uncompressed state, and 1 mm in a compressed state.

Figure 5:
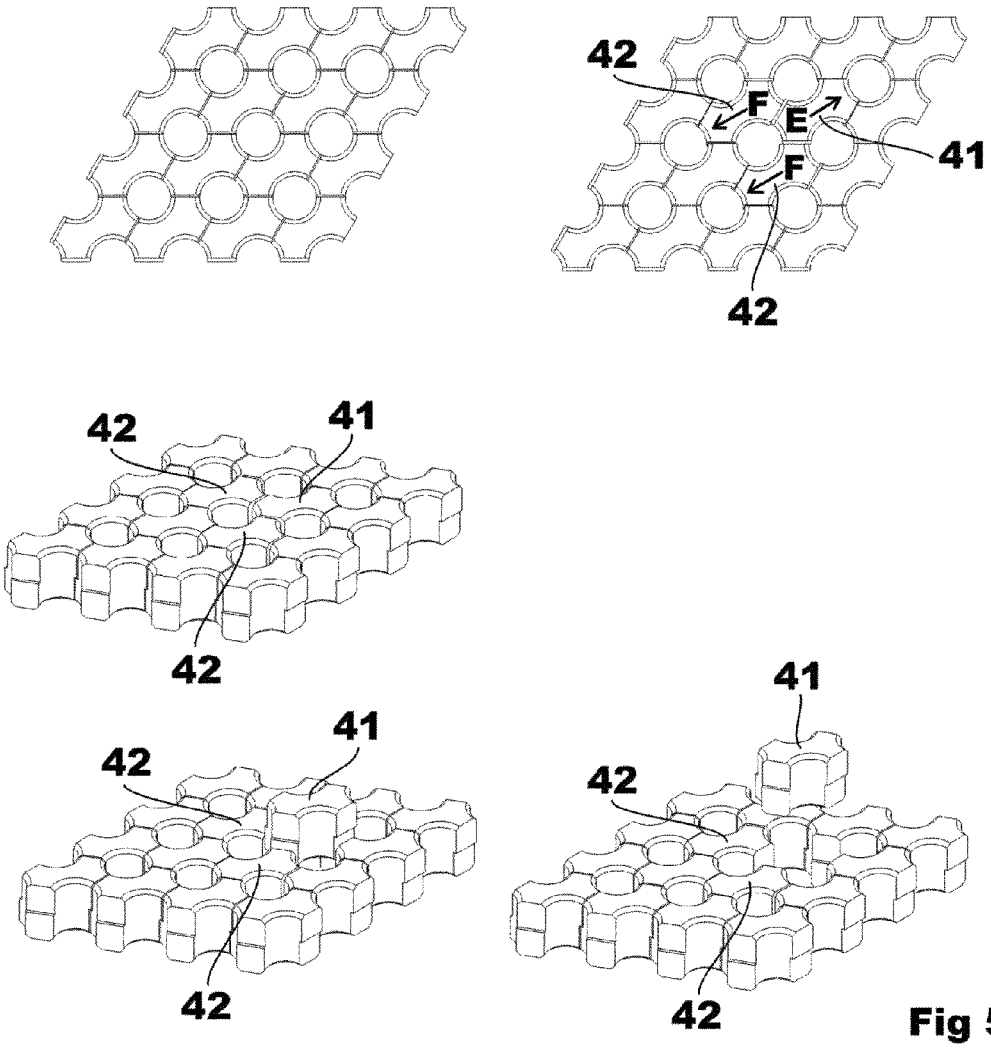
FIG. 5 shows a method for decomposing a composition from FIG. 5.

FIG. 5 shows a method for decomposing a composition from FIG. 5. After removing the ferrules, one of the blocks 41 may be moved in the direction of arrow E, and subsequently the adjacent ones 42 may be moved in direction F. Then, the block 41 may be lifted and taken out.

Figure 6:
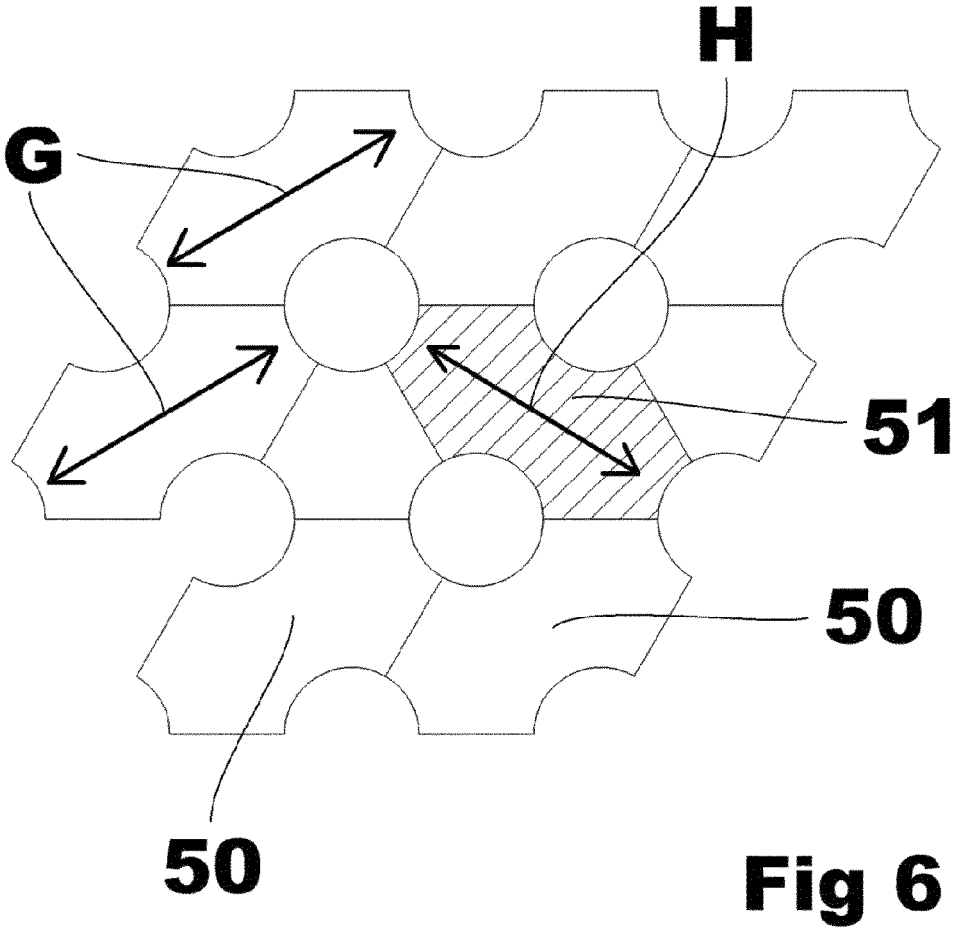
FIG. 6 shows how a double layered boiler wall protection may be arranged.

FIG. 6 shows how a double layered boiler wall protection may be arranged. Blocks 50 form a first layer, with a first length orientation G, while block 51 of a second layer is placed with length orientation H.

Figure 7:
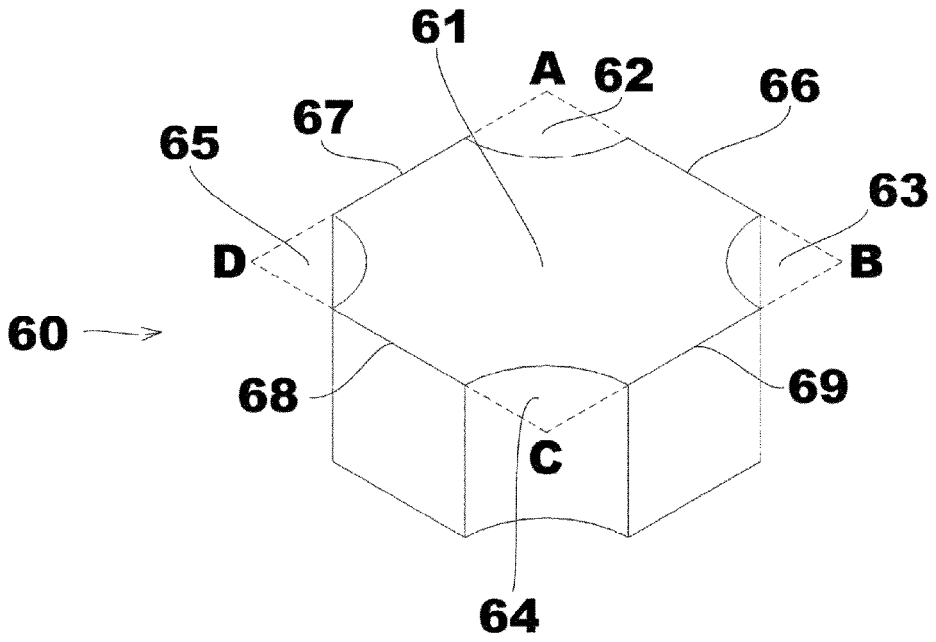
FIG. 7 shows an alternative embodiment of a block according to the invention.

FIG. 7 shows an alternative embodiment 60 of a block according to the invention. The block comprises an essentially square body 61, with an annular cut-out 62, 63, 64, 65 at all four corners, with the cutting point A, B, C, D of two adjacent sides 66, 67, 68, 69 as a centre.

Figure 8:
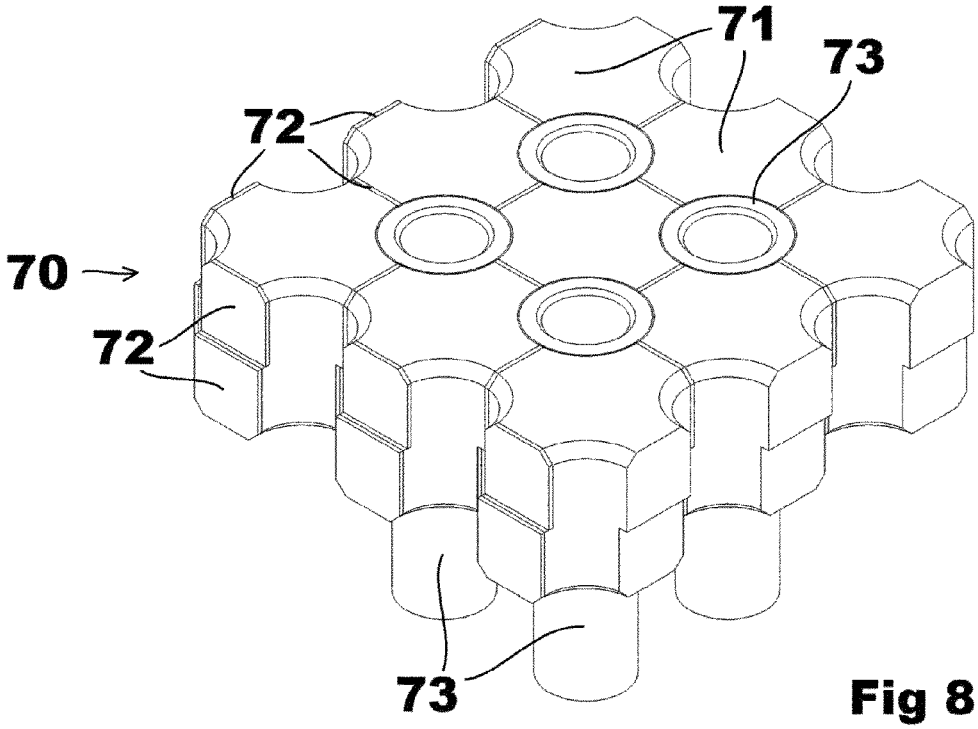
FIG. 8 shows a composition of multiple blocks according to claim 7.

FIG. 8 shows a composition 70 of multiple blocks 71 and ferrules 73 according to the invention. In this example, the ferrules 73 have annular flanges. The blocks 71 are provided with recesses for receiving the annular flanges of the ferrules 73. Also visible in FIG. 8 are the paper gaskets 72 used for obtaining a gas-tight connection.

Figure 9:
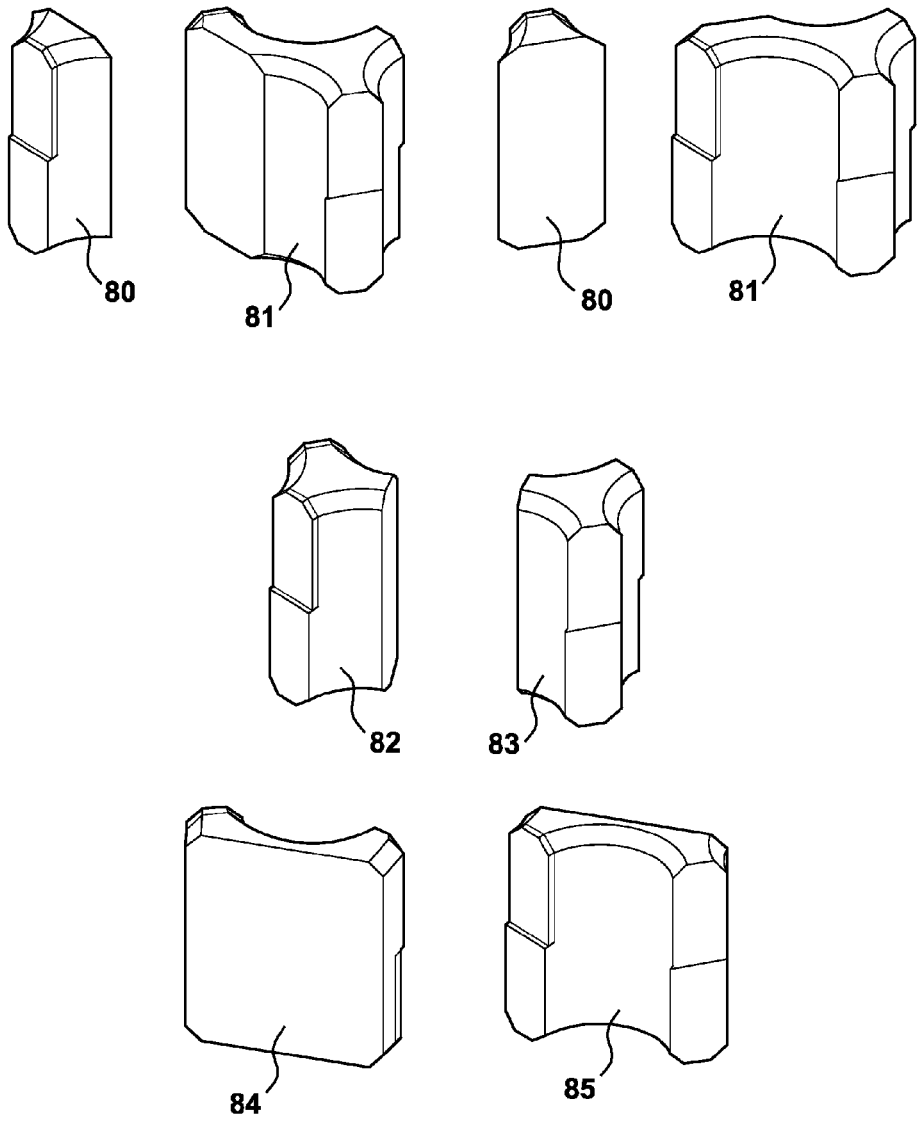
FIG. 9 shows some examples of boiler tube protection sub-blocks.

FIG. 9 shows some examples of boiler tube protection sub-blocks 80-85, comprising a part of a boiler tube protection block from FIG. 1. The parts 80, 81 correspond to a section of the block from one annular cut-out to an adjacent one. The parts 82, 83 and 84, 85 respectively corresponds to a section of the block from one annular cut-out to an opposite one. These boiler tube protection sub-blocks may be manurefactured for the ease of production, or placement of the blocks. Besides the examples given, other sections are thinkable too. The same goes for sub-blocks for forming a boiler tube protection block as shown in FIG. 2.

Besides the examples shown, multiple variations are possible, all falling within the scope of the present application, as determined by the following claims.

The invention claimed is:

1. A boiler wall protection block for building a boiler wall, comprising:

an essentially parallelogram shaped body; and an annular cut-out at all four corners, with the cutting point of two adjacent sides as a centre, wherein each of the annular cut-outs is arranged to receive at least part of a ferrule;

wherein the protection block and the ferrule are distinct, non-integrated structures; and wherein each side of the protection block has a protrusion corresponding to a recess in a neighboring protection block and a recess corresponding to a protrusion in the neighboring protection block preventing direct radiation of heat from reaching the boiler wall.

2. The boiler wall protection block according to claim 1, wherein a first pair of adjacent sides are at an angle of 60 degrees, and a second pair of adjacent sides are at 120 degrees.

3. The boiler wall protection block according to claim 1, wherein a first pair of adjacent sides and a second pair of adjacent sides are all at 90 degrees.

4. The boiler wall protection block according to claim 1, wherein all sides are of equal size.

5. The boiler wall protection block according to claim 1, manufactured of one or more compounds selected from the group consisting of $Al_2O_3$, $ZrO_2$, $SiO_2$, $TiO_2$, $Y_2O_3$, $Na_2O$, $Nb_2O_5$, $La_2O_3$, $Fe_2O_3$, CaO, SrO, $CeO_2$, MgO, $Cr_2O_3$, CuO, the mixed oxides thereof, SiC, TiC, $Si_3N_4$ and AlN.

6. A boiler wall protection element having four boiler wall protection blocks according to claim 1, comprising:

a central annular through hole for the ferrule;

an annular cut-out at the middle of all four sides, with the centre coincident with the side; wherein the central annular through hole and the annular cut-outs at the middle of the four sides have the same radius as the annular cut-out at all four corners.

7. An assembly of a boiler protection element according to claim 6 and the ferrule with a radius corresponding to the central annular hole of the boiler protection element.

8. The assembly according to claim 7, wherein the ferrule comprises a six-sided flange.

9. The assembly according to claim 7, comprising a heat-resistant paper gasket between the boiler wall protection blocks.

10. A boiler wall, comprising an assembly according to claim 7.

11. The boiler wall according to claim 10, comprising a double layer of boiler wall protection blocks, wherein the boiler wall protection blocks of the different layers have a 120 degree different orientation.

12. The boiler wall protection block according to claim 1, wherein each protrusion and recess extends over about half of the thickness of the protection block.

13. The boiler wall protection block according to claim 1, wherein each protrusion and recess extends along an entire side of the protection block preventing direct radiation of heat from reaching the boiler wall.

14. The boiler wall protection block according to claim 1, wherein a paper gasket is positioned between each protrusion and recess of the protection block.

15. The method according to claim 1, wherein adjacent boiler wall protection blocks lock each other together in a roofing-tile wise manner.

16. A method for furnishing a boiler inner wall, comprising:

applying boiler wall protection blocks against the wall, and inserting ferrules through annular cut-outs of the boiler wall protection blocks to secure the boiler wall protection blocks, wherein the protection blocks and the ferrules are distinct, non-integrated structures, and wherein each of the protection blocks has an essentially parallelogram shaped body f with the annular cut-outs at all four corners, with the cutting point of two adjacent sides as a centre, wherein each side of the protection block has a protrusion corresponding to a recess in a neighboring protection block and a recess corresponding to a protrusion in the neighboring protection block preventing direct radiation of heat from reaching the boiler wall.

17. The method according to claim 16, comprising applying multiple layers of boiler wall protection blocks, wherein blocks of adjacent layers have a mutually different orientation.

18. The method according to claim 16, wherein each protrusion and recess extends along an entire side of the protection block preventing direct radiation of heat from reaching the boiler wall.

19. The method according to claim 16, comprising positioning a paper gasket between each protrusion and recess of the protection block.

20. A boiler wall protection sub-block, comprising a part of a boiler wall protection block wherein the part corresponds to a section of the boiler wall protection block from one annular cut-out to an adjacent one or to a section of the block from one annular cut-out to an opposite one, wherein each of the annular cut-outs is arranged to receive at least part of a ferrule, wherein the part of the boiler wall protection block and the ferrule are distinct, non-integrated structures, and wherein the protection block has an essentially parallelogram shaped body of which with the annular cut-outs at all four corners, with the cutting point of two adjacent sides as a centre, wherein each side of the protection block has a protrusion corresponding to a recess in a neighboring protection block and a recess corresponding to a protrusion in the neighboring protection block preventing direct radiation of heat from reaching the boiler wall.

* * * * *